US005927572A

United States Patent [19]

Kiselik

[11] Patent Number: 5,927,572

[45] Date of Patent: Jul. 27, 1999

[54] GARMENT HANGER SHOULDER GUARD

[76] Inventor: Daniel R. Kiselik, 11 Eliot Pl., Short Hills, N.J. 07078-3101

[21] Appl. No.: 09/160,942

[22] Filed: Sep. 25, 1998

[51] Int. Cl.[6] ..... A47G 25/20

[52] U.S. Cl. ..... 223/98; 223/87

[58] Field of Search ..... 223/85, 87, 98, 223/92

[56] References Cited

U.S. PATENT DOCUMENTS

| | | | |
|---|---|---|---|
| 2,008,365 | 7/1935 | Oldham . | |
| 2,106,947 | 2/1938 | Hamilton et al. . | |
| 2,123,369 | 7/1938 | Luecke . | |
| 2,434,461 | 1/1948 | Forcheimer . | |
| 2,581,631 | 1/1952 | Carta . | |
| 2,597,509 | 5/1952 | Mallory | 223/98 |
| 2,665,829 | 1/1954 | Tillery | 223/98 |
| 2,725,165 | 11/1955 | Ohlerich . | |
| 2,873,899 | 2/1959 | Collin | 223/98 |
| 3,031,115 | 4/1962 | Tufts | 223/98 |
| 3,037,676 | 6/1962 | Tillery et al. . | |
| 4,066,193 | 1/1978 | Davis, Jr. . | |
| 5,056,694 | 10/1991 | Michalik | 223/98 |

*Primary Examiner*—Bibhu Mohanty
*Attorney, Agent, or Firm*—Arthur Jacob

[57] ABSTRACT

A garment hanger shoulder guard has an elongate rectangular overall configuration with a generally tubular coupling member at each end of the shoulder guard, the tubular coupling members each having a polygonal cross-sectional configuration by virtue of fold scores which enable the coupling members to be flattened for shipping and storage and erected in the field for assembly with a garment hanger, the fold scores facilitating retention of the coupling members securely coupled with the garment hanger when the coupling members are erect. The elongate rectangular configuration allows a plurality of shoulder guards or shoulder guard blanks to be integrated into a single sheet of card stock material for shipping and storage as a unit, and subsequent separation of the shoulder guards or blanks in the field without waste card stock between contiguous shoulder guards or blanks in the unit.

19 Claims, 4 Drawing Sheets

GARMENT HANGER SHOULDER GUARD

The present invention relates generally to the preservation of desired contours in garments stored and transported on garment hangers and pertains, more specifically, to shoulder guards placed upon garment hangers to protect against unwanted distortion of garments hung on the garment hangers.

By virtue of the versatility and economy provided by garment hangers constructed of wire, the use of wire garment hangers has become widespread in the storage and transport of various garments. Because of the relatively small gage of the wire used in such garment hangers, convention has dictated the use of supplemental supports in connection with the garment hangers for supporting the shoulders of garments hung on the hangers so as to protect against unwanted distortion and creasing and thereby preserve the desired contours of the hung garments while stored and transported on the garment hangers.

As a result, numerous shoulder guard constructions have been proposed and used in connection with garment hangers. The most commonly available shoulder guards are constructed of relatively inexpensive material, such as card stock, which provides sufficient strength and resiliency for the task to be performed, while enabling economy for encouraging widespread use and allowing for expendability.

The present invention provides a shoulder guard which constitutes a unique departure from current shoulder guard configurations, enabling greater economy with increased ease of handling and use, without sacrificing performance. As such, the present invention attains several objects and advantages, some of which are summarized as follows: Enables increased economy through the use of minimal amounts of material and essentially no waste, as a result of an overall configuration which allows such economical construction; allows economical storage and transportation in a flattened condition with ease of erection and assembly with a garment hanger at the site of use; resists inadvertent removal from a garment hanger, once assembled, so as to provide exemplary performance during both storage and transport of the garment hung on the garment hanger; accommodates variations in dimensions and configuration of garment hangers encountered in the field without sacrificing performance; enables quick and simple erection and assembly at the site of use, without littering the site with excess construction material; provides increased versatility, with economy and exemplary performance in the preservation of desired contours in garments hung on garment hangers.

The above objects and advantages, as well as further objects and advantages, are attained by the present invention which may be described briefly as a garment hanger shoulder guard and a blank for constructing the shoulder guard, the shoulder guard being suitable for placement upon a garment hanger having a generally central altitudinally extending suspension hook, longitudinally spaced apart opposite end portions and shoulder portions extending longitudinally and sloping altitudinally between the suspension hook and the opposite end portions for hanging a garment having contours to be supported by the garment hanger, the shoulder guard comprising: an elongate member having a longitudinal length between opposite ends and a lateral width between opposite side edges, the longitudinal length being much greater than the lateral width; an aperture in the elongate member, the aperture being located generally centrally between the opposite ends and the opposite side edges for receiving the suspension hook of the garment hanger; the elongate member including an intermediate portion between the aperture and each of the opposite ends; a coupling member at each of the opposite ends for coupling the opposite ends to corresponding opposite end portions of the garment hanger, each coupling member having a tubular configuration and including a generally tubular wall extending laterally across the elongate member at a corresponding end of the elongate member; a slot in the tubular wall, the slot passing longitudinally through the tubular wall and extending altitudinally for receiving a corresponding end portion of the garment hanger and gripping the corresponding end portion to couple the elongate member to the garment hanger when the coupling member is erect; and at least one fold score extending along the tubular wall, laterally across the elongate member, for enabling selective collapse of the tubular configuration to render the shoulder guard flattened for shipping and storage, and selective erection of the tubular configuration for coupling the shoulder guard with the garment hanger, with the fold score facilitating retention of the coupling member securely coupled with the corresponding end portion of the garment hanger. The shoulder guards and the blanks may be shipped or stored in units of multiple shoulder guards or blanks integrated into a single sheet and selectively separated at the site of use for erection of the shoulder guards and assembly of the erected shoulder guards with the garment hangers.

The invention will be understood more fully, while still further objects and advantages will become apparent, in the following detailed description of a preferred embodiment of the invention illustrated in the accompanying drawing, in which.

Figure 1:
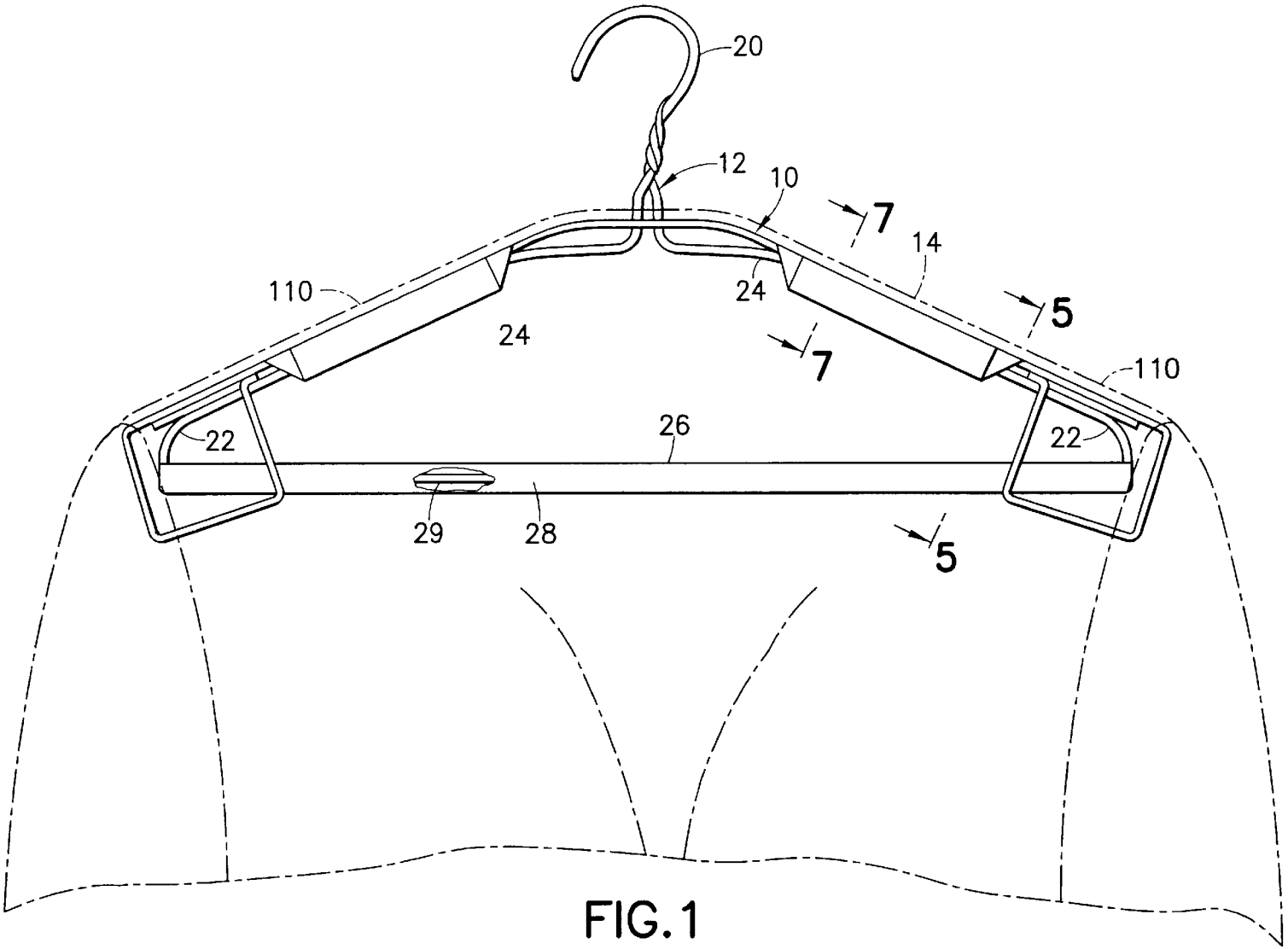
FIG. 1 is a front elevational view showing a shoulder guard constructed in accordance with the present invention, erected and assembled with a garment hanger upon which a garment is to be hung.

Referring now to the drawing, and especially to FIG. 1 thereof, a shoulder guard constructed in accordance with the present invention is illustrated generally at 10 and is seen to be erected and assembled with a garment hanger 12 upon which a garment, in the form of jacket 14, is to be hung for storage or for transportation. Garment hanger 12 is a typical wire hanger currently in use and is seen to include a generally central suspension hook 20 which extends in an altitudinal direction, longitudinally spaced apart opposite end portions 22, and shoulder portions 24 extending longitudinally and sloping altitudinally downwardly between the suspension hook 20 and the opposite end portions 22. Hanger 12 further is provided with a cross-bar 26 which extends longitudinally between the opposite end portions 22, altitudinally below the suspension hook 20 and which carries a tube 28 having a diameter considerably larger than the wire core 29 of cross-bar 26.

Figure 2:
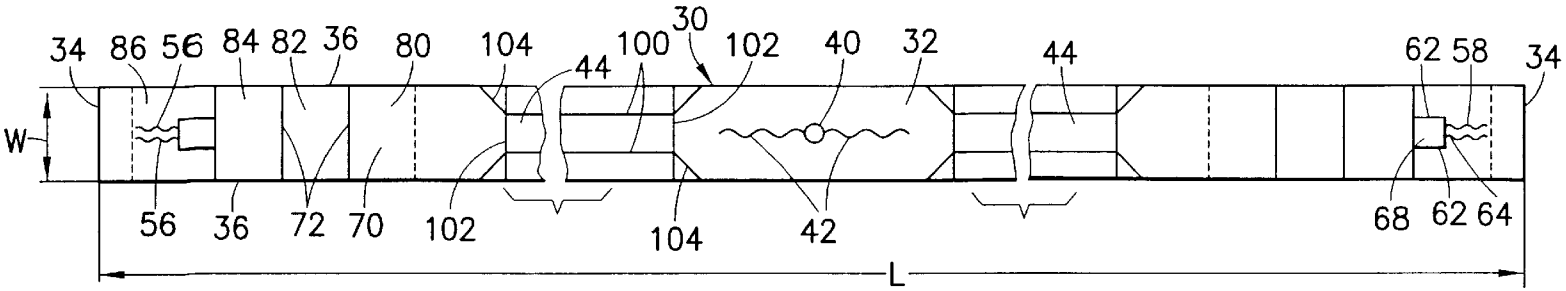
FIG. 2 is a top plan view of a blank from which the shoulder guard is to be erected.
Figure 3:
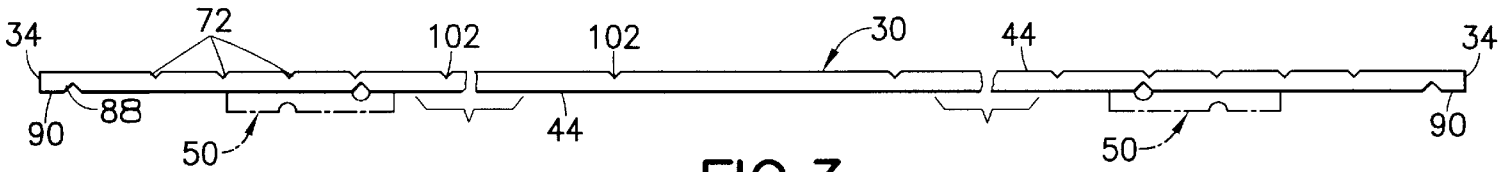
FIG. 3 is a front side elevational view of the blank.
Figure 4:
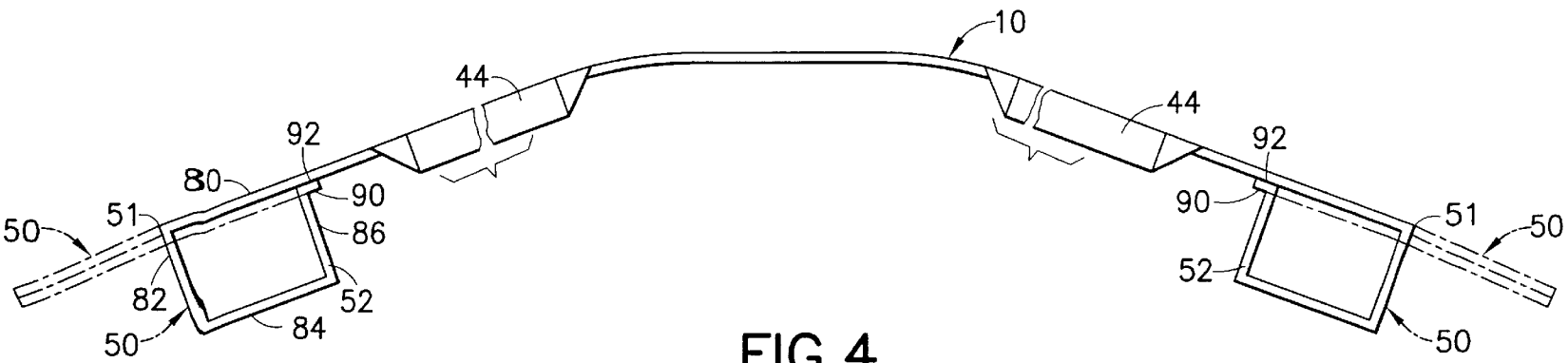
FIG. 4 is a front side elevational view of the erected shoulder guard.

Turning now to FIGS. 2 through 4, as well as to FIG. 1, shoulder guard 10 is erected from a blank 30 which is seen to include an elongate member 32 having a longitudinal length L between opposite ends 34, and a lateral width W between opposite side edges 36, the longitudinal length L being much greater than the lateral width W. In a typical shoulder guard blank 30, the longitudinal length L is about thirty-two inches, while the lateral width is about one and one-half inches. An aperture 40 is located generally centrally between the opposite ends 34 and the opposite side edges 36, and passes through the elongate member 32 for receiving the suspension hook 20 of the garment hanger 12. Serpentine slits 42 in the elongate member 32 extend longitudinally from the aperture 40, in a now-conventional manner, to assist in the passage of the suspension hook 20 through the elongate member 32. An intermediate portion 44 of the elongate member 32 extends longitudinally between the aperture 40 and each of the opposite ends 34.

Figure 6:
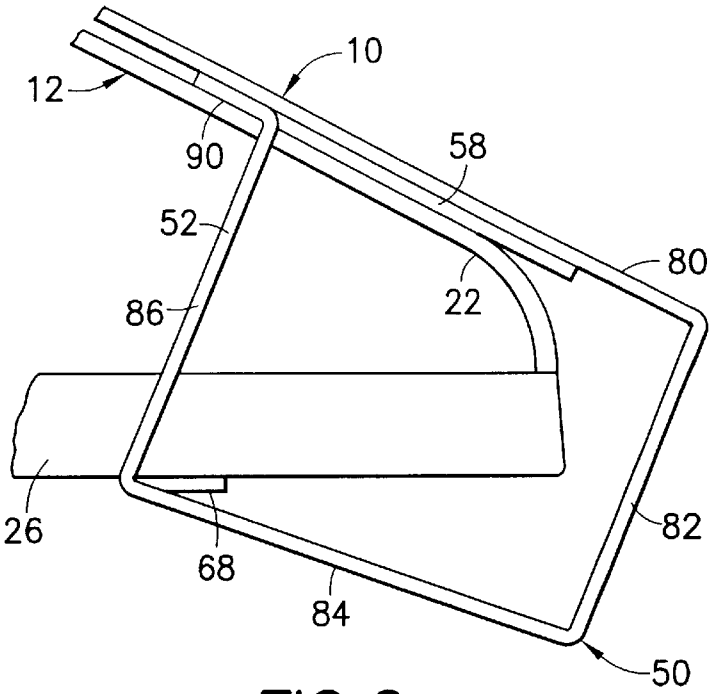
FIG. 6 is an enlarged fragmentary elevational view of a portion of FIG. 1.
Figure 7:
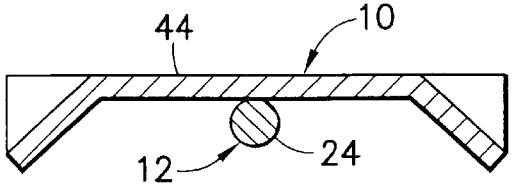
FIG. 7 is an enlarged cross-sectional view taken along line 7—7 of FIG. 1.
Figure 5:
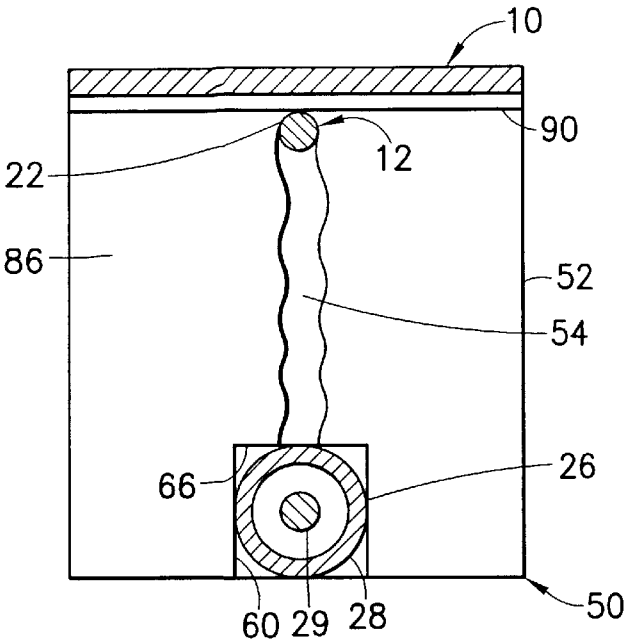
FIG. 5 is an enlarged cross-sectional view taken along line 5—5 of FIG. 1.

A coupling member 50 is located at each of opposite ends 51 of the erected shoulder guard 10 for coupling the opposite ends 51 to corresponding end portions 22 of the garment hanger 12. To that end, each coupling member 50 includes a generally tubular wall 52 extending laterally across the elongate member 32 at a corresponding end 51 of the shoulder guard 10, and a slot 54 extending altitudinally along the tubular wall 52, as seen in FIG. 5, and passing longitudinally through the tubular wall 52 for receiving the corresponding end portion 22 of the garment hanger 12, as illustrated in FIG. 6. In the preferred construction, the slot 54 is established by a pair of slits 56 having a serpentine configuration and being spaced apart laterally to define the width of the slot 54. A flap 58 between the slits 56 is displaced by the end portion 22 of the garment hanger 12 as the end portion 22 is inserted into the slot 54 for being captured in the slot 54 and remains integral with the tubular wall 52 so that the length of the slot 54 is extended to a length just sufficient to accommodate the corresponding dimension of the garment hanger 12, which dimension may vary from one garment hanger to another, without the necessity for extending the slot 54 beyond that required for receiving the end portion 22 of the garment hanger 12. In this manner, the structural integrity of the coupling member 50 is enhanced for better coupling of the shoulder guard 10 with the garment hanger 12. Further, after displacement, the flap 58 remains integral with the shoulder guard 10 thereby eliminating any litter which otherwise could accumulate at the erection site if the material between the slits 56 were to be released from the shoulder guard 10 upon erection and assembly.

Similarly, the coupling member 50 includes a further slot 60 extending altitudinally along the tubular wall 52, as seen in FIG. 5, and passing longitudinally through the tubular wall 52 for receiving the cross-bar 26 of the garment hanger 12, as illustrated in FIG. 6. In the preferred construction, the further slot 60 is established by a pair of further slits 62 extending altitudinally and spaced apart laterally to define the width of the slot 60, and a still further slit 64 extending laterally to define the altitudinally upper edge 66 of the slot 60 and a flap 68 bounded by the slits 62 and 64. Flap 68 is displaced by the cross-bar 26 of the garment hanger 12 as the cross-bar 26 is inserted into the slot 60 for being captured in the slot 60 and remains integral with the tubular wall 52 so that the flap 68 remains integral with the shoulder guard 10, after displacement, thereby eliminating any litter which otherwise could accumulate at the erection site if the material between the slits 62 were to be released from the shoulder guard 10 upon erection and assembly. The width of slot 60 is greater than the width of slot 54 for accommodating the larger diameter of tube 28 in frictional gripping engagement, and the upper edge 66 of slot 60 serves as a stop shoulder which confines the cross-bar 26 to the slot 60.

Returning to FIGS. 2 and 3, the blank 30 is constructed of a relatively inexpensive and expendable material having a resilience and durability commensurate with the performance required for the shoulder guard 10. A preferred material is card stock, of the type commonly used for shoulder guards. Blank 30 initially is in the form of an elongate flat strip 70 into which is punched aperture 40. Slits 42, 56, 62 and 4 are cut into the strip 70 at locations in the strip 70 which correspond to the positions of the slits 42, 56, 62 and 64 desired in the erected shoulder guard 10. A number of fold scores 72 are placed in strip 70 so as to extend laterally across the blank 30 adjacent each end 34 of the blank 30 to establish panels 80, 82, 84 and 86, and a further fold score 88 establishes an end tab 90. The coupling members 50 then are formed by folding the blank 30 along the fold scores 72 and 88 to establish the tubular wall 52, as illustrated in FIG. 4, and then affixing the end tab 90, as by an adhesive connection at 92, to complete the tubular configuration of the tubular wall 52. The panel 86, which carries slots 54 and 60, then becomes oriented in an altitudinal direction so as to be in position to confront a corresponding end portion 22 of the garment hanger 12 for reception and capture of the end portion 22. The tubular wall 52 is collapsed readily, as illustrated in phantom in FIGS. 3 and 4, for storage and shipment of the completed shoulder guard 10 in a flattened condition and is erected easily at the site of use by merely unfolding the tubular wall 52. Thus, the location of the fold scores 72 and 88 and the position and dimensions of the panels 80, 82, 84 and 86 enable ready selective collapse and erection of the shoulder guard 10. Moreover, the employment of at least one fold score 72 to establish a coupling member 50 having a polygonal cross-sectional configuration facilitates retention of the coupling member 50 on the end portion 22 of the garment hanger 10 by relieving any resilient "memory" in the material of the shoulder guard 10 at the coupling member 50, which resilient memory otherwise might overcome the frictional coupling between the coupling member 50 and the end portion 22 of the garment hanger 12 and thereby tend to pull away and uncouple the coupling member 50 from the garment hanger 12, especially during storage and transportation of the garment hung on the garment hanger 12. Ease of collapse and erection of the tubular wall 52, as well as the attainment of the desirable flattened condition, is further facilitated by orienting the end tab 90 so that the end tab 90, when affixed in place, extends in the direction from the fold score 88 toward the aperture 40. In the preferred construction, the number of fold scores 72 and 88 is such that the polygonal cross-sectional configuration of coupling member 50 is essentially rectangular.

As best seen in FIGS. 1 and 6, the intermediate portions 44 preferably are provided with further fold scores proximate the side edges 36, the further fold scores including longitudinally extending fold scores 100, fold scores 102 extending laterally across the elongate member 32, and intermediate fold scores 104, all for facilitating folding of the elongate member 32 along the intermediate portions 44 to conform the intermediate portions 44 more closely to the contour of the jacket 14 at the shoulders 110 of the jacket 14.

Figure 8:
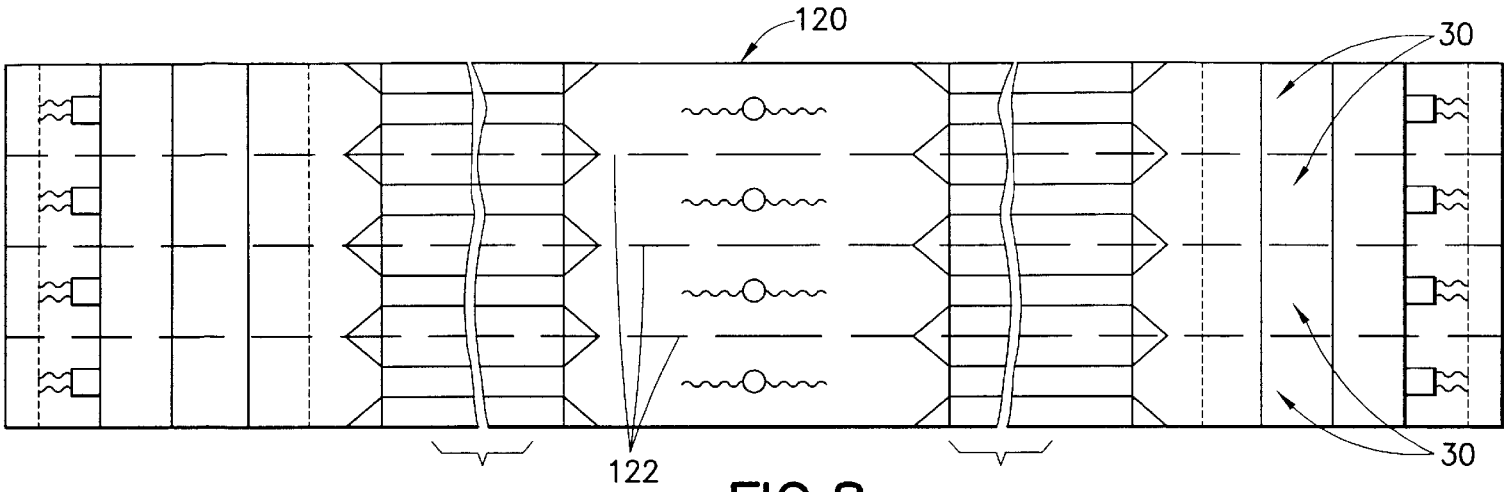
FIG. 8 is a top plan view of a sheet of blanks prepared for shipment to a site where shoulder guards will be erected and assembled with garment hangers.
Figure 9:
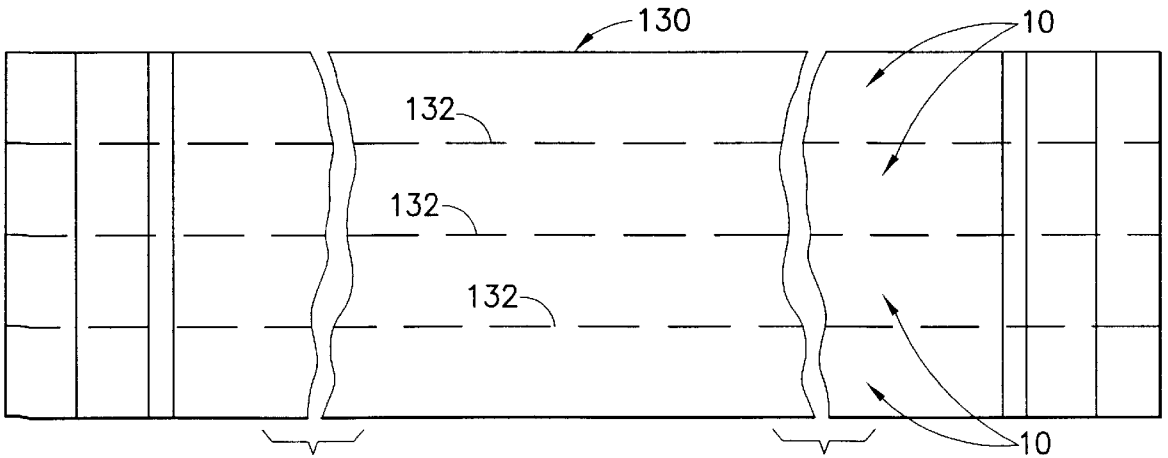
FIG. 9 is a bottom plan view of a sheet of shoulder guards prepared for shipment to a site where the shoulder guards will be erected and assembled with garment hangers.

It will be evident that the generally rectangular overall plan configuration of the blank 30 enables a plurality of blanks to be cut from a larger rectangular sheet of stock material without waste, thereby improving economy. Further, as illustrated in FIGS. 8 and 9, the rectangular overall plan configuration of blank 30 allows a plurality of blanks 30 or shoulder guards 10 to be constructed and held together in a single sheet forming a flattened unit for convenience in delivery to a site of use and for facilitating storage. Thus, unit 120 includes several blanks 30, held together in unit 120 and divided by perforated scores 122 for selective separation of the blanks 30 to erect shoulder guards 10 at the point of assembly with garment hangers 12. Unit 130 includes several shoulder guards 10 held together in unit 130 and divided by perforated scores 132 for selective separation of the shoulder guards 10 at the point of assembly with garment hangers 12. In this manner, multiple blanks 30 or multiple shoulder guards 10 are handled with increase ease and economy, and without the generation of waste material.

It will be seen that the present invention attains the objects and advantages summarized above, namely: Enables increased economy through the use of minimal amounts of material and essentially no waste, as a result of an overall configuration which allows such economical construction; allows economical storage and transportation in a flattened condition with ease of erection and assembly with a garment hanger at the site of use; resists inadvertent removal from a garment hanger, once assembled, so as to provide exemplary performance during both storage and transport of the garment hung on the garment hanger; accommodates variations in dimensions and configuration of garment hangers encountered in the field without sacrificing performance; enables quick and simple erection and assembly at the site of use, without littering the site with excess construction material; provides increased versatility, with economy and exemplary performance in the preservation of desired contours in garments hung on garment hangers.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A garment hanger shoulder guard for placement upon a garment hanger having a generally central altitudinally extending suspension hook, longitudinally spaced apart opposite end portions and shoulder portions extending longitudinally and sloping altitudinally between the suspension hook and the opposite end portions for hanging a garment having contours to be supported by the garment hanger, the shoulder guard comprising:

an elongate member having a longitudinal length between opposite ends and a lateral width between opposite side edges, the longitudinal length being much greater than the lateral width;

an aperture in the elongate member, the aperture being located generally centrally between the opposite ends and the opposite side edges for receiving the suspension hook of the garment hanger;

the elongate member including an intermediate portion between the aperture and each of the opposite ends;

a coupling member at each of the opposite ends for coupling the opposite ends to corresponding opposite end portions of the garment hanger, each coupling member having a tubular configuration and including a generally tubular wall extending laterally across the elongate member at a corresponding end of the elongate member;

a slot in the tubular wall, the slot passing longitudinally through the tubular wall and extending altitudinally for receiving a corresponding end portion of the garment hanger and gripping the corresponding end portion to couple the elongate member to the garment hanger when the coupling member is erect; and at least one fold score extending along the tubular wall, laterally across the elongate member, for enabling selective collapse of the tubular configuration to render the shoulder guard flattened for shipping and storage, and selective erection of the tubular configuration for coupling the shoulder guard with the garment hanger, with the fold score facilitating retention of the coupling member securely coupled with the corresponding end portion of the garment hanger.

2. The invention of claim 1 wherein each coupling member includes a tab located between the corresponding end of the elongate member and the fold score for affixing the corresponding end to a corresponding intermediate portion of the elongate member located between the aperture and the corresponding end.

3. The invention of claim 2 wherein the tab, when affixed to the intermediate portion of the elongate member, extends in a direction from the fold score toward the aperture.

4. The invention of claim 1 wherein each coupling member includes a number of fold scores extending along the tubular wall, laterally across the elongate member, whereby the erect tubular configuration has a polygonal cross-sectional configuration corresponding to the number of fold scores.

5. The invention of claim 4 wherein the polygonal cross-sectional configuration is essentially rectangular.

6. The invention of claim 4 wherein the tubular wall includes an altitudinal panel for confronting the corresponding end portion of the garment hanger, and the slot is located in the altitudinal panel.

7. The invention of claim 6 wherein the altitudinal panel includes laterally spaced apart, altitudinally extending slits defining a flap between the slits whereby displacement of the flap from between the slits establishes the slot while the flap remains integral with the elongate member.

8. The invention of claim 7 wherein the garment hanger includes a cross-bar extending longitudinally between the opposite end portions, altitudinally below the suspension hook, and the altitudinal panel includes spaced apart further slits defining a further flap between the further slits whereby displacement of the further flap from between the further slits establishes a further slot for reception of the cross-bar within the coupling member, while the further flap remains integral with the elongate member.

9. The invention of claim 1 including further fold scores extending along the intermediate portions of the elongate member, proximate to the side edges of the elongate member, for facilitating folding of the elongate member along the intermediate portions to conform the intermediate portions more closely to the contours of the garment to be hung on the garment hanger.

10. The invention of claim 9 wherein the further fold scores include longitudinally extending fold scores adjacent corresponding side edges of the elongate member.

11. The invention of claim 1 wherein the opposite ends and the opposite side edges of the elongate member define an essentially rectangular overall configuration.

12. A blank of card stock material for constructing a garment hanger shoulder guard to be placed upon a garment hanger having a generally central altitudinally extending suspension hook, longitudinally spaced apart opposite end portions and shoulder portions extending longitudinally and sloping altitudinally between the suspension hook and the opposite end portions for hanging a garment having contours to be supported by the garment hanger, the blank comprising:

an elongate member having a longitudinal length between opposite ends and a lateral width between opposite side edges, the longitudinal length being much greater than the lateral width;

an aperture in the elongate member, the aperture being located generally centrally between the opposite ends and the opposite side edges for receiving the suspension hook of the garment hanger;

the elongate member including an intermediate portion located between the aperture and each of the opposite ends;

a slot in the elongate member, the slot passing longitudinally through the elongate member and placed on the elongate member so as to extend altitudinally for receiving a corresponding end portion of the garment hanger and gripping the corresponding end portion to couple the elongate member to the garment hanger when the coupling members are erect; and at least one fold score extending laterally across the elongate member adjacent each of the opposite ends of the elongate member, for enabling erection of a coupling member having a tubular cross-sectional configuration at each of the opposite ends for coupling the opposite ends to corresponding opposite end portions of the garment hanger, each fold score being located to enable selective collapse of the tubular cross-sectional configuration of a corresponding coupling member to render the shoulder guard flattened for shipping and storage, and selective erection of the coupling member for coupling the shoulder guard with the garment hanger, with the fold score facilitating retention of the coupling member securely coupled with the corresponding end portion of the garment hanger.

13. The invention of claim 12 including a tab adjacent each of the opposite ends of the elongate member for affixing each of the opposite ends to a corresponding intermediate portion of the elongate member located between the aperture and a corresponding one of the opposite ends for establishing the coupling members.

14. The invention of claim 12 including a number of fold scores extending laterally across the elongate member for providing the erect coupling members with a polygonal cross-sectional configuration corresponding to the number of fold scores.

15. The invention of claim 14 wherein the polygonal cross-sectional configuration is essentially rectangular.

16. A blank of card stock material for constructing a plurality of garment hanger shoulder guards to be placed upon a corresponding plurality of garment hangers, each garment hanger having a generally central altitudinally extending suspension hook, longitudinally spaced apart opposite end portions and shoulder portions extending longitudinally and sloping altitudinally between the suspension hook and the opposite end portions for hanging a garment having contours to be supported by the garment hanger, the blank comprising:

a corresponding plurality of contiguous elongate members each having a longitudinal length between opposite ends and a lateral width between opposite side edges, the longitudinal length being much greater than the lateral width;

an aperture in each elongate member, the aperture being located generally centrally between the opposite ends and the opposite side edges for receiving the suspension hook of the garment hanger;

each elongate member including an intermediate portion located between the aperture and each of the opposite ends;

a slot in the elongate member, the slot passing through the elongate member and placed on the elongate member so as to extend altitudinally for receiving a corresponding end portion of a garment hanger and gripping the corresponding end portion to couple each elongate member to a corresponding garment hanger when the coupling members are erect;

at least one fold score extending laterally across each elongate member adjacent each of the opposite ends of the elongate member, for enabling erection of a coupling member at each of the opposite ends for coupling the opposite ends to corresponding opposite end portions of a garment hanger, such that each fold score enables selective collapse of the coupling member to render each shoulder guard flattened for shipping and storage, and selective erection of the coupling member for coupling each shoulder guard with a garment hanger, with the fold score facilitating retention of the coupling member securely coupled with the corresponding end portion of the garment hanger;

perforated scores between contiguous elongate members for enabling shipping and storage of the plurality of elongate members as a unit, and selective separation of the elongate members to establish separate shoulder guards.

17. The invention of claim 16 wherein the elongate members each have a rectangular overall configuration such that the elongate members are capable of being separated without waste card stock material between contiguous elongate members.

18. A plurality of garment hanger shoulder guards for placement upon a corresponding plurality of garment hangers, each garment hanger having a generally central altitudinally extending suspension hook, longitudinally spaced apart opposite end portions and shoulder portions extending longitudinally and sloping altitudinally between the suspension hook and the opposite end portions for hanging a garment having contours to be supported by the garment hanger, the shoulder guards each comprising:

an elongate member having a longitudinal length between opposite ends and a lateral width between opposite side edges, the longitudinal length being much greater than the lateral width;

an aperture in the elongate member, the aperture being located generally centrally between the opposite ends and the opposite side edges for receiving the suspension hook of the garment hanger;

the elongate member including an intermediate portion between the aperture and each of the opposite ends;

a coupling member at each of the opposite ends for coupling the opposite ends to corresponding opposite end portions of the garment hanger, each coupling member having a tubular configuration and including a generally tubular wall extending laterally across the elongate member at a corresponding end of the elongate member;

a slot in the tubular wall, the slot passing longitudinally through the tubular wall and extending altitudinally for receiving a corresponding end portion of the garment hanger and gripping the corresponding end portion to couple the elongate member to the garment hanger; and at least one fold score extending along the tubular wall, laterally across the elongate member, for enabling selective collapse of the tubular configuration to render the shoulder guard flattened for shipping and storage, and selective erection of the tubular configuration for coupling the shoulder guard with the garment hanger, with the fold score facilitating retention of the coupling member securely coupled with the corresponding end portion of the garment hanger;

the plurality of shoulder guards being joined together along perforated scores placed between contiguous shoulder guards for enabling shipping and storage of the plurality of shoulder guards as a unit, and selective separation of the shoulder guards to establish separate shoulder guards at a site of use.

19. The invention of claim 18 wherein the plurality of shoulder guards are integrated into a sheet of card stock material, each shoulder guard having a rectangular overall configuration such that the shoulder guards are capable of being separated without waste card stock material between contiguous shoulder guards.

* * * * *